US008956132B2

(12) United States Patent
Satou et al.

(10) Patent No.: US 8,956,132 B2
(45) Date of Patent: Feb. 17, 2015

(54) COMPRESSOR

(75) Inventors: Keita Satou, Saitama (JP); Makoto Kawamura, Saitama (JP); Hiroshi Iijima, Saitama (JP); Hiroyuki Sato, Saitama (JP); Keisuke Nakazawa, Saitama (JP); Yukihiko Ando, Saitama (JP); Tohru Kamiyama, Saitama (JP); Hiroyuki Seimiya, Saitama (JP); Hiroki Shinkawa, Saitama (JP); Fumiaki Maruoka, Saitama (JP); Katsumi Endou, Saitama (JP); Masanori Ogawa, Saitama (JP)

(73) Assignee: Calsonic Kansei Corporation, Saitama (JP)

( * ) Notice: Subject to any disclaimer, the term of this patent is extended or adjusted under 35 U.S.C. 154(b) by 190 days.

(21) Appl. No.: 13/479,543

(22) Filed: May 24, 2012

(65) Prior Publication Data

US 2012/0301343 A1 Nov. 29, 2012

(30) Foreign Application Priority Data

May 27, 2011 (JP) ..... 2011-119552

(51) Int. Cl.

| | |
|---|---|
| ***F04C 29/02*** | (2006.01) |
| ***F01C 21/08*** | (2006.01) |
| ***F04C 28/24*** | (2006.01) |
| ***F04C 18/344*** | (2006.01) |

(52) U.S. Cl.

CPC ..... *F01C 21/0872* (2013.01); *F04C 28/24* (2013.01); *F04C 29/026* (2013.01); *F04C 18/3446* (2013.01); *Y10S 418/01* (2013.01); *Y10S 55/14* (2013.01)

USPC ..... 418/84; 418/76; 418/97; 418/DIG. 1; 184/6.16; 55/DIG. 14

(58) Field of Classification Search

USPC ..... 418/84, 87, DIG. 1, 55.1, 76, 82, 93, 418/96–98, 133, 259, 266–268, 270; 184/6.2, 6.16–6.18; 55/421, 422, 521, 55/DIG. 14

See application file for complete search history.

(56) References Cited

U.S. PATENT DOCUMENTS

| | | | | |
|---|---|---|---|---|
| 4,743,183 | A * | 5/1988 | Irie et al. | 418/76 |
| 5,499,515 | A | 3/1996 | Kawamura et al. | |
| 5,954,482 | A * | 9/1999 | Ijiri et al. | 418/87 |
| 7,537,436 | B2 * | 5/2009 | Kitamura et al. | 418/DIG. 1 |
| 7,789,202 | B2 * | 9/2010 | Lee et al. | 184/6.2 |
| 7,836,696 | B2 * | 11/2010 | Uno et al. | 418/55.1 |
| 8,092,200 | B2 * | 1/2012 | IiJima et al. | 418/97 |
| 2010/0242422 | A1 | 9/2010 | Heikamp | |

FOREIGN PATENT DOCUMENTS

| | | |
|---|---|---|
| CN | 201125867 | 10/2008 |
| CN | 101545490 | 9/2009 |

(Continued)

*Primary Examiner* — Thomas Denion
*Assistant Examiner* — Thomas Olszewski
(74) *Attorney, Agent, or Firm* — Wenderoth, Lind & Ponack, LLP.

(57) ABSTRACT

A compressor includes a main body having in a housing a vane back-pressure space configured to project a vane forming a compression room for compressing gas, and a centrifugal oil separator. A discharge section to which the gas from the oil separator is ejected is formed in the housing, and the oil separator includes a pressure-adjusting valve configured to adjust pressure of the vane back-pressure space according to pressure of the discharge section. The pressure-adjusting valve is arranged in the oil separator without being affected by the gas ejected from the oil separator.

10 Claims, 7 Drawing Sheets

(56) References Cited

FOREIGN PATENT DOCUMENTS

| | | |
|---|---|---|
| CN | 101835522 | 9/2010 |
| EP | 0 761 975 | 3/1997 |
| JP | 7-12072 | 1/1995 |
| JP | 2003-201964 | 7/2003 |
| JP | 2004-190510 | 7/2004 |
| JP | 2008-223526 | 9/2008 |
| JP | 2010-144548 | 7/2010 |

* cited by examiner

SECT. A-A

VIEW.B

SECT.D-D

COMPRESSOR

PRIORITY CLAIM

The present application is based on and claims priority from Japanese Patent Application No. 2011-119552, filed on May 27, 2011, the disclosure of which is hereby incorporated by reference in its entirety.

BACKGROUND

1. Field of the Invention

The present invention relates to a compressor, and in particular, to the arrangement of a pressure-regulating valve in an oil separator mounted on a compressor main body.

2. Description of the Related Art

A compressor, which compresses gas such as refrigerant gas to circulate the gas in an air-conditioning system, is conventionally used in an air-conditioning system.

The compressor includes a main body which is housed in a housing and compresses gas by rotary driving, and a discharge section to which high-pressure gas is ejected from the main body. The compressor is configured to discharge the high-pressure gas outside the housing from the discharge section.

The compressor main body includes an oil separator which separates oil from the high-pressure gas ejected from the compressor main body. The oil separated by the oil separator is accumulated in the bottom of the discharge section.

The oil accumulated in the bottom of the discharge section is guided to the compressor main body by the pressure (pressure of high-pressure gas) in the discharge section.

The compressor main body includes a rotation shaft rotating by an applied rotary driving force, a cylindrical rotor rotating integrally with the rotation shaft, a cylinder arranged outside the outer circumferential face of the rotor, and including an inner circumferential face having an approximately ellipsoidal shape in section, two side blocks which cover both end faces of the cylinder and the rotor, and a plurality of plate-like vanes buried in the rotor at equal angular intervals about the rotation shaft. Each of the vanes is projectable from the outer circumferential face of the rotor by back-pressure. The projection amount changes according to the rotation of the rotor while the projected leading ends of the vanes have contact with the inner circumferential face of the cylinder.

Compression rooms are formed by the rotor, cylinder, both side blocks and two vanes in tandem in the rotation direction of the rotor. Gas is sucked in each compression room, then is compressed, and is ejected to the discharge section as high-pressure gas due to the change in the volume of each compression room according to the rotation of the rotor.

The projection force of the vane is too strong if the vane receives high back-pressure although the back-pressure is oil guided to the compressor main body. This causes excessively strong contact between the leading end of the vane and the inner circumferential face of the cylinder. For this reason, a limiter, which limits the pressure of the guided oil to an intermediate pressure lower than the pressure in the discharge section, is provided in the compressor main body. The oil limited to the intermediate pressure is supplied to an oil path and a vane back-pressure space.

In addition, the projection force of the vane is increased not only by the back-pressure that the vane receives but also a centrifugal force generated by the rotation of the rotor.

In this case, the vanes follow the inner circumferential face of the cylinder by the above-described operation during the normal rotation of the compressor. However, the inner pressure in the discharge section is lowered if the compressor is maintained in a resting state, and the back-pressure of the vanes is also lowered. For this reason, the leading ends of some vanes are separated from the inner circumferential face of the cylinder due to their own weights, and thus, some compression rooms are not formed.

If the compressor starts up in such a state, the back-pressure is small just after the start of the rotation of the rotor. Thus, it may take a long time to obtain constant high-pressure gas because the vanes do not instantly project.

The leading ends of the vanes are separated from the inner circumferential face of the cylinder due to the pressure of the compression rooms acting on the leading ends of the vanes pressed against the inner circumferential face of the cylinder if the back-pressure of the vanes is not increased to a certain degree. This may cause chattering.

Therefore, Japanese Patent Application Publication No. 2008-223526 proposes to create a high-pressure bypass from a vane back-pressure space to a discharge section in an oil separator, and to provide in the high-pressure bypass a pressure-regulating valve which opens the bypass until the pressure (static pressure) in the discharge section reaches predetermined pressure and closes the bypass after the pressure (static pressure) in the discharge section reaches the predetermined pressure as a mechanism for improving the projection performance of the vanes just after the start-up of the compressor.

In this compressor, the pressure-regulating valve opens the high-pressure bypass just after the startup of the compressor. With this configuration, the inner pressure in the discharge section directly acts on the oil path without the limiter, and the back-pressure of the vanes is increased so as to be higher than the pressure through the limiter, so that the projection performance of the vanes can be improved.

The oil separator includes a centrifugal-type oil separator which centrifugally separates oil by a force when compressed gas is ejected from the compressor main body. This oil separator includes an inside space surrounded by an inner circumferential wall face which centrifugally separates oil by a force when compressed gas is ejected from the compressor main body, and a bottom wall face in which the centrifugally-separated oil falls. The centrifugally-separated oil in the inside space is discharged to the lower portion of the discharge section from an oil discharge hole formed in the bottom wall face.

The pressure-regulating valve provided in the oil separator may be affected by dynamic pressure because the jet flow (dynamic pressure) of the gas ejected from the oil separator is strong. The pressure-regulating valve closes the bypass due to the impact of the dynamic pressure even if the pressure (static pressure) in the discharge section does not reach predetermined pressure.

Therefore, the pressure value of the pressure-regulating valve should be set in accordance with the strength of the jet flow (dynamic pressure) of the gas ejected from the oil separator. However, making such a setting is difficult in practice because the strength of the jet flow changes according to the rotation number and the pressure of the compressor.

SUMMARY

It is, therefore, an object of the present invention to provide a compressor in which a pressure-regulating value accurately opens and closes a path by means of predetermined pressure (static pressure) of a discharge section.

In order to achieve the above object, an embodiment of the present invention provides a compressor including a main body having in a housing a vane back-pressure space configured to project a vane forming a compression room for compressing gas, and a centrifugal oil separator. A discharge section to which the gas from the oil separator is ejected is formed in the housing, and the oil separator includes a pressure-adjusting valve configured to adjust the pressure of the vane back-pressure space according to the pressure of the discharge section. The pressure-adjusting valve is provided in the oil separator without being affected by the gas ejected from the oil separator.

BRIEF DESCRIPTION OF THE DRAWINGS

The accompanying drawings are included to provide further understanding of the invention, and are incorporated in and constitute a part of this specification. The drawings illustrate an embodiment of the invention and, together with the specification, serve to explain the principle of the invention.

FIG. 6A is a view illustrating a condition in which refrigerant oil and liquid refrigerant are accumulated and FIG. 6B is a view illustrating a condition in which the accumulated refrigerant oil and liquid refrigerant are agitated.

DESCRIPTION OF THE PREFERRED EMBODIMENT

Hereinafter, an embodiment according to a compressor of the present invention will be described with reference to the drawings.

(Constitution)

Figure 1:
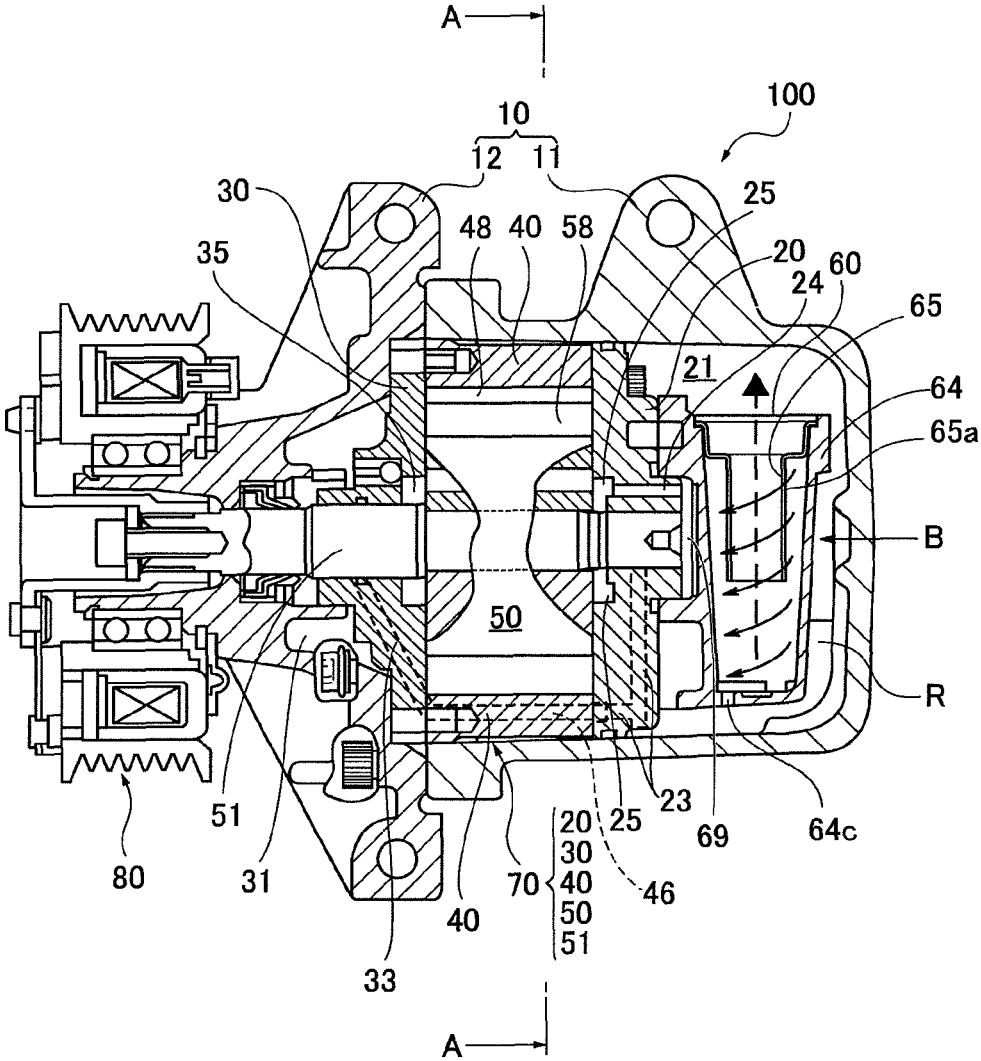
FIG. 1 is a longitudinal sectional view illustrating a vane rotary type compressor of one embodiment of a compressor according to the present invention.
Figure 2:
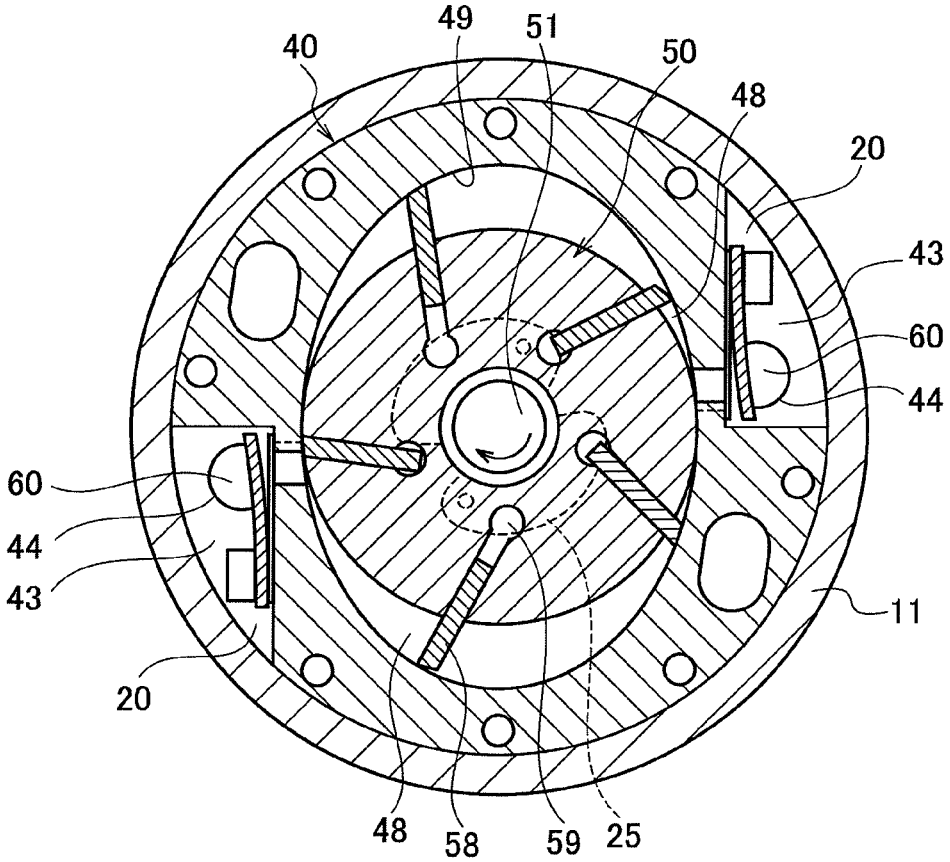
FIG. 2 is a sectional view along A-A line in FIG. 1.

FIG. 1 is a longitudinal sectional view illustrating a vane rotary type compressor 100 (hereinafter referred to as a compressor 100) of one embodiment of a compressor according to the present invention. FIG. 2 is a cross-sectional view along A-A line in FIG. 1.

The compressor 100 is a part of an air-conditioning system which performs cooling with vaporization heat of a cooling medium, for example. The compressor 100 is provided on a circulation path for the cooling medium together with a not shown condenser, expansion valve, evaporator and the like as other constitutional elements of the air-conditioning system.

The compressor 100 compresses refrigerant gas G as a cooling medium introduced from the evaporator of the air-conditioning system, and supplies the compressed refrigerant gas G in the condenser of the air-conditioning system. The condenser devolatilizes the compressed refrigerant gas G, and sends it to the expansion value as high-pressure liquid refrigerant.

The high-pressure liquid refrigerant is changed into low-pressure liquid refrigerant in the expansion valve, and the low-pressure liquid refrigerant is sent to the evaporator. The low-pressure liquid refrigerant vaporizes by absorbing heat from peripheral air in the evaporator, and cools the peripheral air of the evaporator by the heat exchange with the vaporization heat.

The compressor 100 includes a main body 70 housed in a housing 10 having a case 11 and a front head 12, a cyclone block 60 (centrifugal oil separator) and a driver 80 which is mounted on the front head 12, and transfers a driving force from a not shown driving source to the main body.

The case 11 includes a tubular body having a closed first end. The front head 12 is assembled in the case 11 to cover an open second end of the case 11. The front head 12 includes a not shown intake port which sucks in the low-pressure refrigerant gas G from the evaporator. The case 11 includes a not shown discharge port which discharges the high-pressure refrigerant gas G compressed in the compressor main body to the condenser.

An intake room 31 of a space which leads to the intake port and a discharge section 21 of a space which leads to the discharge port are formed inside the housing 10 by the inner face of the housing 10 and the outer face of the main body 70.

The main body 70 includes a rotation shaft 51, rotor 50, cylinder 40, five vanes 58, a front side block 30 and rear side block 20.

The rotation shaft 51 rotates about an axis by a driving force transmitted by the driver 80.

The rotor 50 includes a cylindrical shape coaxial with the rotation shaft 51 and rotates together with the rotation shaft 51.

The cylinder 40 includes an inner circumferential face 49 having an approximately ellipsoidal shape in a sectional contour surrounding an outer circumferential face of the rotor 50 (see FIG. 2), and includes both open ends.

The five vanes 58 are provided at equal angular intervals about the rotation shaft 51. Each of the five vanes 58 is buried in a vane groove 59 extending to both end faces of the rotor 50, and is projectable outwardly (toward the inner circumferential face 49 of the cylinder 40) from the outer circumferential face of the rotor 50 by receiving the vane back-pressure due to the refrigerant oil R supplied through the openings of the vane groove 59 on both end faces of the rotor 50. With this constitution, the projection amount of the leading end of the vane 58 is changed to follow the contour shape of the inner circumferential face 49 of the cylinder 40.

The front side block 30 is fixed to cover the end face of the cylinder 40 on the intake room 31 side. The rear side block 20 is fixed to cover the end face of the cylinder 40 on the discharge section 21 side.

Through holes as bearings, each of which rotatably supports a part of the rotation shaft 51 projecting from each of both end faces of the rotor 50, are formed in the approximate central portion of the two side blocks 20, 30, respectively.

Five compression rooms 48 are formed inside a portion surrounded by the two side blocks 20, 30 and the cylinder 40 in the main body 70.

These compression rooms 48 are spaces sectioned by the two side blocks 20, 30, cylinder 40, rotor 50 and two vanes 58, 58 in tandem in the rotation direction of the rotation shaft 51.

These compression rooms 48 are configured to compress the refrigerant gas G sucked inside the compression rooms 48 with the repetition of the increase and decrease in the volume according to the rotation of the rotor 50.

In the progression of the increase in the volume of the compression rooms 48, the refrigerant gas G of the intake room 31 is sucked in the compression rooms 48 through a not shown intake window formed in the front side block 30. In the progress of the decrease in the volume of the compression rooms 48, the refrigerant gas G closed in the compression rooms 48 is compressed, so that the temperature and pressure of the refrigerant gas G are increased, and the high temperature and pressure refrigerant gas G is discharged in a discharge chamber 43 (refer to FIG. 2) of a space sectioned by the cylinder 40, case 11 and two side blocks 20, 30.

The high temperature and pressure refrigerant gas G discharged in the discharge chamber 43 is discharged through a chamber hole 44 formed in a portion which sections the discharge chamber 43 in the rear side block 20.

The discharged refrigerant gas G is introduced in the cyclone block 60.

The cyclone block 60 is attached firmly to the rear side block 20, and includes a main body 64 having an approximately cylindrical outer circumferential wall with a closed lower end and a pipe 65 provided in the inside space of the outer circumferential wall to be substantially coaxial with the cylinder of the outer circumferential wall.

Concave portions 61*a*, 62*b* facing the above-described two chamber holes 44, respectively, are formed in the face (hereinafter referred to as a back face, refer to FIG. 3B) of the cyclone block 60 which is attached firmly to the rear side block 20.

One concave portion 61*a* leads to a groove 61 formed on the back face of the cyclone block 60, and the other concave portion 62*a* leads to a groove 62 formed on the back face of the cyclone block 60.

The end portion of the groove 61 on the side opposite to the side which leads to the concave portion 61*a* and the end portion of the groove 62 on the side opposite to the side which leads to the concave portion 62*a* intersect to form a junction 63. This junction 63 leads to a space between the inside of the outer circumferential wall of the main body 64 and the outside of the pipe 65.

Consequently, the refrigerant gas G discharged from the respective chamber holes 44 of the rear side block 20 enters in the concave portions 61*a*, 62*a* of the cyclone block 60 corresponding to the respective chamber holes 44, and reaches the junction 63 through the corresponding grooves 61, 62 from the respective concave portions 61*a*, 62*a*.

The refrigerant gas G is guided in the space between the inside of the outer circumferential wall of the main body 64 and the outside of the pipe 65 from the junction 63, and moves downwardly while spirally circling in the space.

Refrigerant oil R is mixed with the refrigerant gas G discharged from the compression rooms 48. A strong centrifugal force acts on the refrigerant gas G including the refrigerant oil R when the refrigerant gas G circles in the space.

As a result, the refrigerant oil R mixed in the refrigerant gas G is separated from the refrigerant gas G by the centrifugal force, falls in the bottom of the inside of the main body 64, is ejected downwardly in the figure from a discharge hole 64*c* formed in the bottom, and is accumulated in the bottom of the discharge section 21.

In contrast, the refrigerant gas G from which the refrigerant oil R is separated flows upwardly in the figure through the space inside the pipe 65, and is discharged outside the compressor 100 from the above-described discharge port through the discharge section 21 from the opening of the upper end of the cyclone block 60.

A round hole 68 to which a boss formed around the through hole as a bearing of the rear side block is fitted is formed on the back face of the cyclone block 60. The after-described vane back-pressure space 69 is formed between the round hole 68 and the end face of the boss of the rear side block 20 in a condition in which the cyclone block 60 is attached firmly to the rear side block 20.

The after-described trigger valve 66 (pressure-adjusting valve) which supports the smooth projection of the vanes 58 at the time of startup of the compressor 100 is provided in the cyclone block 60.

Figure 4:
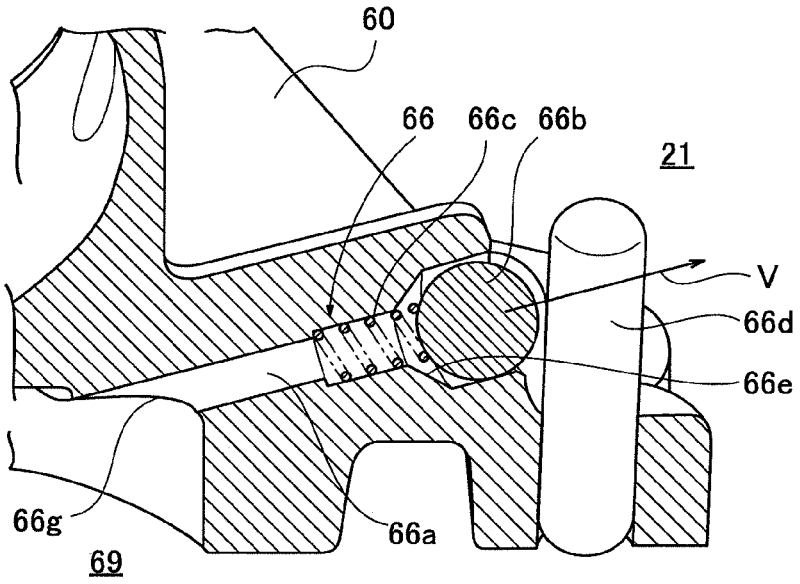
FIG. 4 is a sectional view along D-D line in FIG. 3A.

As illustrated in FIG. 4, the trigger valve 66 includes a path 66*a* which connects the discharge section 21 with the vane back-pressure space 69, and a valve member comprising a ball valve 66*b* movable between a position which closes the path 66*a* (hereinafter referred to as a closed position) and a position which opens the path 66*a* (hereinafter referred to as an open position), a spring 66*c* which presses the ball valve 66*b* on the side of the open position by an elastic force, and a valve retaining pin 66*d* which prevents the ball valve 66*b* from falling in the discharge section 21.

In this case, the closed position is a position where the outer circumferential face of the ball valve 66*b* has contact with a seat 66*e* formed in the path 66*a*. In contrast, the open position is a position in a range where the outer circumferential face of the ball valve 66*b* is separated from the seat 66*e* of the path 66*a*.

The valve retaining pin 66*d* has contact with the ball valve 66*b* in the open position, so as to prevent the falling of the ball valve 66*b*.

The load according to the pressure of the vane back-pressure space 69 and the elastic force of the spring 66*c* act on the ball valve 66*b* toward the open position. In contrast, the load according to the pressure of the discharge section 21 acts on the ball valve 66*b* toward the closed position.

The ball valve 66*b* is in the closed position to close the path 66*a* if the difference between the pressure of the discharge section 21 and the pressure of the vane back-pressure space 69 exceeds the elastic force of the spring 66*c*. Thus, the distribution of the gas and the fluid between the discharge section 21 and the vane back-pressure space 69 is stopped (the trigger valve 66 is closed).

As described above, the trigger valve 66 is closed during the constant driving of the compressor 100, for example.

The ball valve 66*b* is in the open position to open the path 66*a* if the difference between the pressure of the discharge section 21 and the pressure of the vane back-pressure space 69 lowers the elastic force of the spring 66*c*. Thus, the distribution of the gas and the fluid between the discharge section 21 and the vane back-pressure space 69 is allowed (the trigger valve 66 opens).

As described above, the trigger valve 66 opens during a relatively long resting condition of the compressor 100, just after the restart of the driving from the resting condition (just after startup) or the like.

The path 66*a* is formed in a linear fashion. An opening 66*f* of the path 66*a* on the side provided with the ball valve 66*b* is not formed in an area E1 (an area where the gas is ejected from the oil separator) above an opening face 64*a* of the upper end from which the refrigerant gas G is ejected, namely, the area E1 where the ball valve 66*b* may be affected by the ejection pressure (dynamic pressure) of the refrigerant gas G which is intermittently ejected from the cyclone block 60. The opening 66*f* also is not formed in an area E2 (an area where the centrifugally-separated oil is ejected from the oil separator) under a bottom 64*b* provided with the discharge hole 64*c* from which the refrigerant oil R is ejected, namely, the area E2 where the ball valve 66*b* may be affected by the ejection pressure (dynamic pressure) of the refrigerant oil R which is intermittently ejected from the cyclone block 60.

Namely, the trigger valve 66 is provided in an area (area except area E1 and area except area E2) where it is not affected by the dynamic pressure of the refrigerant oil R and the refrigerant gas G ejected from the cyclone block 60 on the discharge section 21 side.

Figure 3A:
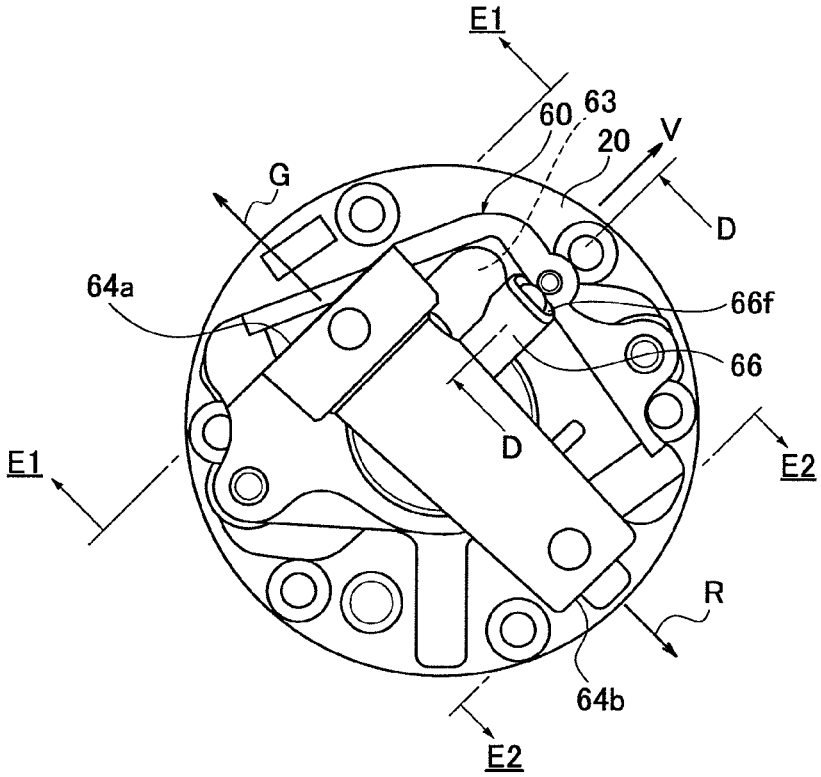
FIG. 3A is a view illustrating a cyclone block and a rear side block from the arrow B in FIG. 1.
Figure 3B:
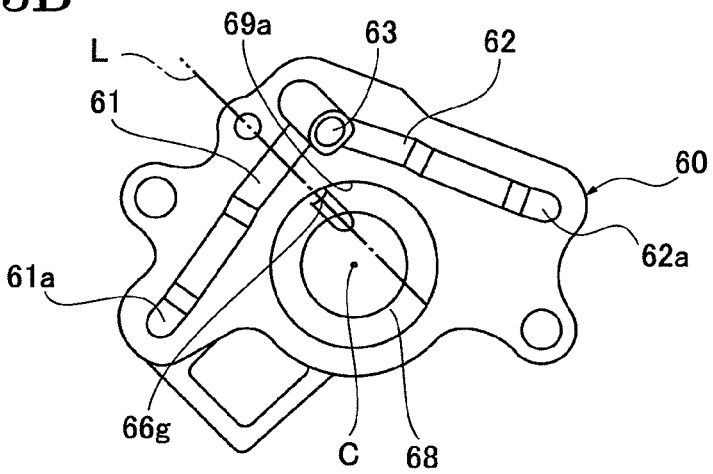
FIG. 3B is a back view of the cyclone block in FIG. 3A as seen from the side of the rear side block.

An opening 66*g* of the path 66*a* on the side facing the vane back-pressure space 69 opens under a top portion 69*a* of the vane back-pressure space 69 as illustrated in FIG. 3B.

Figure 6A:
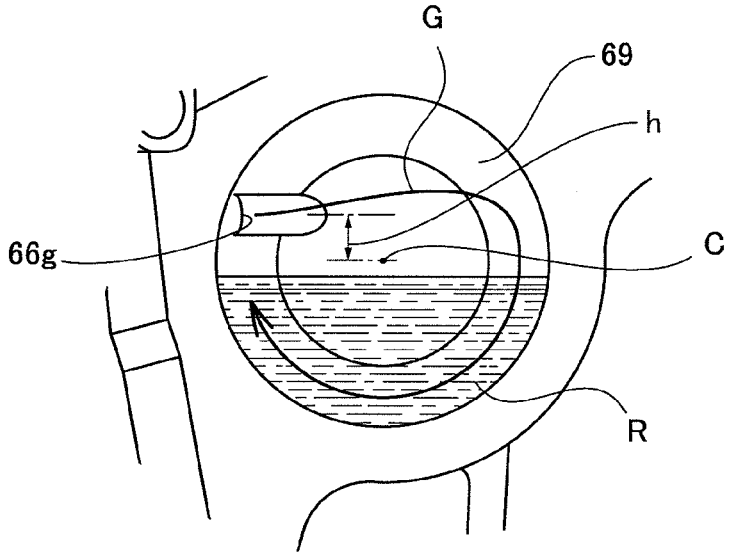
FIGS. 6A, 6B are views each illustrating an opening of a path of a trigger valve in a vane back-pressure space.

The opening 66*g* opens in a position (a position higher than the center C by the height h) above the center C (the center C of the rotation axis 51) of the vane back-pressure space 69 which is coaxial with the center C of the rotation axis 51 as illustrated in FIG. 6A.

Namely, the path 66*a* extends in a linear fashion, but the extending direction V of the path 66*a* does not pass through the center C of the vane back-pressure space 69, and the path 66*a* is formed to be eccentric from the center C of the vane back-pressure space 69.

The refrigerant oil R accumulated in the bottom of the discharge section 21 is used to lubricate, cool and clean a sliding portion and the like of the compressor 100, and to apply the back-pressure on the vanes 58 such that the vanes project toward the inner circumferential face 49 of the cylinder 40 and to energize the vanes 58 such that the leading ends of the vanes have contact with the inner circumferential face 49.

An oil path 23 which guides the high-pressure refrigerant oil R accumulated in the bottom of the discharge section 21 due to the pressure of the refrigerant gas G discharged in the discharge section 21 to the end face of the rotor 50 is formed in the rear side block 20 of the compressor main body 70.

The oil path 23 extends to the bearing of the rear side block 20. A part of the refrigerant oil R guided to the bearing is supplied to a groove 25 for accumulating oil formed on the end face of the rear side block 20 through a small space between the bearing and the outer circumferential face of the rotation shaft 51.

In contrast, another part of the refrigerant oil R guided to the bearing is guided to the vane back-pressure space 69 on the side provided with the cyclone block 60 through the small space between the bearing and the outer circumferential face of the rotation shaft 51, and is supplied to the groove 25 through a communication path 24 from the vane back-pressure space 69.

The refrigerant oil R supplied to the groove 25 receives the pressure loss while passing through the small space between the outer circumferential face of the rotation shaft 51 and the bearing, so that the pressure of the refrigerant oil R supplied to the groove 25 is lower than the pressure of the refrigerant oil R accumulated in the discharge section 21.

Oil paths 46, 33 which guide the refrigerant oil R to the other end face of the rotor 50 are formed in the cylinder 40 and the front side block 30, respectively, similar to the rear side block 20.

The oil path 33 extends to the bearing of the front side block 30. The refrigerant oil R guided to the bearing of the front side block 30 through the oil paths 23, 46, 33 is supplied to the groove 35 formed on the end face of the front side block 30 through the small space between the bearing and the outer circumferential face of the rotation shaft 51.

In this case, each vane groove 59 rotates according to the rotation of the rotor 50. The refrigerant oil R is supplied to the vane grooves 59 from the grooves 25, 35 while the openings of the vane grooves 59 on both ends of the rotor 50 face the groove 25 of the rear side block 20 and the groove 35 of the front side block 30, respectively. The supplied refrigerant oil R operates as the vane back-pressure for projecting the vanes.

(Operation)

According to the compressor 100 of the embodiment as described above, the five compression rooms 48 are formed during a normal driving condition, namely, due to the back-pressure appropriately applied to the vanes 58. The trigger valve 66 provided in the cyclone block 60 is closed during a driving condition in which a previously set rate output (for example, discharge amount) is obtained.

More specifically, according to the compressor 100 of the present embodiment, the load (the load according to the pressure of the discharge section 21) toward the closed position acting on the ball valve 66*b* of the trigger valve 66 exceeds the load (the sum of the load according to the pressure of the vane back-pressure space 69 and the elastic force of the spring 66*c*) toward the open position because the pressure of the discharge section 21 is considerably higher than the pressure of the vane back-pressure space 69. For this reason, the outer circumferential face of the ball valve 66*b* has contact with the seat 66*e* of the path 66*a*, so as to close the path 66*a*. With this constitution, the high pressure of the discharge section 21 does not act on the vane back-pressure space 69 through the path 66*a*. Accordingly, it becomes possible to avoid a problem which may be caused if the high pressure of the discharge section 21 acts on the vane back-pressure space 69, namely, a problem of an increase in a friction loss due to the increased contact pressure between the leading ends of the vanes 58 and the inner circumferential face 49 of the cylinder 40 by the excessively increased back-pressure of the vanes 58.

On the other hand, the pressure of the refrigerant gas G is changed to be made uniform in the entire air-conditioning system if the compressor 100 is maintained in a resting condition (non-driving condition) for a long period of time.

As a result, the inner pressure of the discharge section 21 is decreased to decrease the back-pressure of the vane grooves 59, so that some of the vanes fall in the vane grooves 59 of the rotor 50 by their own weights, disturbing the formation of the compression room 48.

Upon the startup of the compressor 100 without having the trigger valve 66, the pressure of the discharge section 21 is not rapidly increased in the initial stage just after the startup because some of the compression rooms 48 are not formed. For this reason, the back-pressure acting on the vane grooves 59 is not rapidly increased, so that it takes a long time to form all of the compression rooms 48, and to stabilize the compressor 100 in a normal driving condition.

However, the compressor 100 of the present embodiment includes the trigger valve 66. In the above-described condition, the load (the load according to the pressure of the discharge section 21) toward the closed position acting on the ball valve 66*b* of the trigger valve 66 lowers the load (the sum of the load according to the pressure of the vane back-pressure space 69 and the elastic force of the spring 66*c*) toward the open position. The outer circumferential face of the ball valve 66*b* is thereby separated from the seat 66*e* of the path 66*a* to open the path 66*a*. The high-pressure refrigerant gas G of the discharge section 21, which is relatively higher than that of the vane back-pressure space 69, flows in the vane back-pressure space 69 through the path 66*a*, the pressure of the vane back-pressure space 69 is thereby increased, the pressure of the vane grooves 59 is also increased and the smooth projection of the vanes 58 is supported.

Therefore, it becomes possible to reduce a time required for stabilizing the compressor 100 in a normal driving condition.

The load (the load according to the pressure of the discharge section 21) toward the closed position acting on the ball valve 66*b* of the trigger valve 66 exceeds the load toward the open position (the sum of the load according to the pressure of the vane back-pressure space 69 and the elastic force of the spring 66*c*) because the pressure of the discharge section 21 is considerably increased until the compressor 100 is stabilized in a normal driving condition or after the compressor 100 is stabilized in a normal driving condition.

By doing this, the outer circumferential face of the ball valve 66*b* has contact with the seat 66*e* of the path 66*a* to close the path 66*a*, so that the relatively high-pressure refrigerant gas G of the discharge section 21 does not flow in the vane back-pressure space 69.

Consequently, it becomes possible to prevent an increase in the friction resistance which may be caused if the vane back-pressure is excessively increased because the vane back-pressure acting on the vane grooves 59 is not excessively increased over the pressure in a normal driving condition (in the condition in which the non-formation of the compression rooms 48 due to the separation of the leading ends of the vanes 58 from the inner circumferential face 49 of the cylinder 40 does not occur).

Moreover, according to the compressor 100 of the present embodiment, the trigger valve 66 is provided in the cyclone block 60. With this constitution, the trigger valve 66 can be provided even if there is no space or not enough space for providing the trigger value in the compressor main body 70.

According to the compressor 100 of the present embodiment, the trigger valve 66 is disposed in the area (area except area E1 and area except area E2) which is not affected by the dynamic pressure of the refrigerant oil R and the refrigerant gas G ejected from the cyclone block 60 as illustrated in FIGS. 3A, 3B.

Specifically, the opening 66*f* on the side facing the discharge section 21 is not formed in the area E1 above the opening surface 64*a* of the cyclone block 60 from which the refrigerant gas G is ejected and also in the area E2 under the bottom 64*b* provided with the discharge hole 64*c* of the cyclone block 60 from which the refrigerant oil R is ejected.

Therefore, the ball valve 66*b* of the trigger valve 66 is not affected by the dynamic pressure of the refrigerant oil R and the refrigerant gas G ejected from the cyclone block 60.

More specifically, the operation of the trigger valve 66 depends on the pressure of the discharge section 21, the pressure of the vane back-pressure space 69 and the spring constant of the spring 66*c*. The spring constant of the spring 66*c* is previously set based on the pressure (static pressure) of the discharge section 21 and the pressure (static pressure) of the vane back-pressure space 69.

However, the pressure (the pressure affected by the dynamic pressure) of the discharge section 21 that the ball valve 66*b* of the trigger valve 66 receives becomes a different pressure from the pressure (static pressure) of the discharge section 21 assumed when setting the spring constant of the spring 66*c* if the opening 66*f* on the side facing the discharge section 21 is disposed in the area E1 which may be affected by the dynamic pressure of the refrigerant gas G and the area E2 which may be affected by the dynamic pressure of the refrigerant oil R.

As a result, the trigger valve 66 would operate in response to a different pressure from the assumed pressure, and the operation of the trigger valve 66 may not be appropriately achieved.

However, according to the compressor 100 of the present embodiment, the opening 66*f* of the trigger valve 66 opens in a position which is not affected by the dynamic pressure of the refrigerant gas G which is intermittently ejected from the cyclone block 60, so that the ball valve 66*b* is not affected by the dynamic pressure. For this reason, the trigger valve 66 operates with the assumed pressure, and the operation of the trigger valve 66 can be appropriately achieved.

Further, according to the compressor 100 of the present embodiment, the opening 66*f* of the trigger valve 66 is in a position which is not affected by the dynamic pressure of the refrigerant oil R which is intermittently ejected from the cyclone block 60, so that the ball valve 66*b* is not affected by the dynamic pressure. For this reason, the trigger valve 66 operates with the assumed pressure, and the operation of the trigger valve 66 can be further appropriately achieved.

In addition, as illustrated in FIGS. 3A, 3B, the direction V in which the opening 66*f* faces the discharge section 21 is a direction substantially orthogonal to both the direction of the refrigerant oil R and the direction of the refrigerant gas G ejected from the cyclone block 60. Thus, the opening 66*f* is hardly affected by the dynamic pressure of the refrigerant gas G and the dynamic pressure of the refrigerant oil R at the same time.

According to the compressor 100 of the present embodiment, the opening 66*f* of the trigger valve 66 facing the discharge section 21 opens in the area which is not affected by the dynamic pressure of the refrigerant gas G and the dynamic pressure of the refrigerant oil R ejected from the cyclone block 60. However, the compressor 100 of the present invention is not limited thereto. The opening 66*f* of the trigger valve 66 facing the discharge section 21 may open in an area which is not affected only by the dynamic pressure of the refrigerant gas G ejected from the cyclone block 60. The accuracy of the operation of the trigger valve 66 can be improved by simply eliminating the influence due to the refrigerant gas G because the influence due to the dynamic pressure of the refrigerant oil R is smaller than the influence due to the dynamic pressure of the refrigerant gas G.

Accordingly, the direction V facing the discharge section 21 of the opening 66*f* of the trigger valve 66 is not limited to the direction substantially orthogonal to both of the direction of the refrigerant oil R and the direction of the refrigerant gas G ejected from the cyclone block 60.

According to the compressor 100 of the present embodiment, the opening 66*f* of the trigger valve 66 facing the discharge section 21 opens in the area (areas except areas E1, E2) which is not affected by the dynamic pressure of the refrigerant gas G and the dynamic pressure of the refrigerant oil R ejected from the cyclone block 60, so as to prevent the operation of the trigger valve 66 from being affected by the dynamic pressure of the refrigerant gas G and the dynamic pressure of the refrigerant oil R ejected from the cyclone block 60. However, the compressor of the present invention is not limited thereto.

Figure 5:
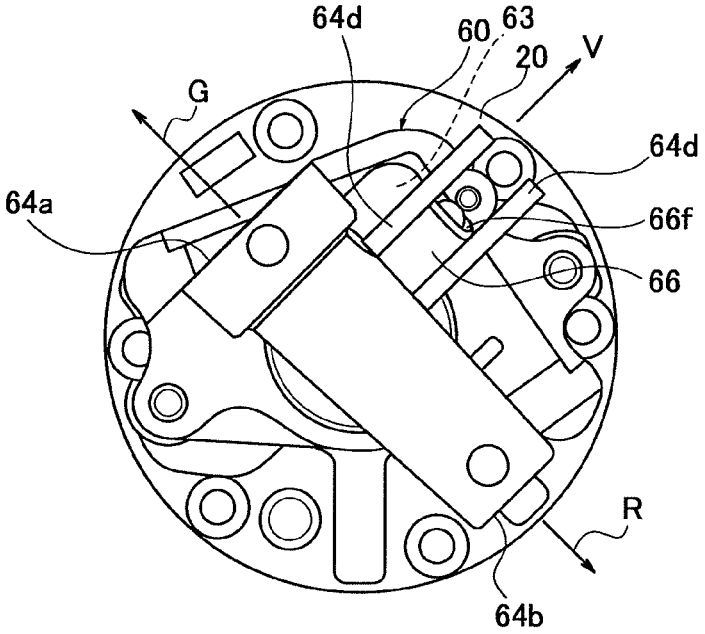
FIG. 5 is a view corresponding to FIG. 3A, which illustrates one example of another embodiment.

Namely, as illustrated in FIG. 5, for example, closure plates 64*d*, 64*d* (closure members) which cover the circumferential portion of the opening 66*f* of the trigger valve 66 (not the entire of the circumferential portion) to block the ejecting refrigerant gas G and refrigerant oil R can be used.

With this configuration, the operation of the trigger valve 66 is prevented from being affected by the dynamic pressure of the ejecting refrigerant gas G and refrigerant oil R.

In this case, as illustrated in FIG. 5, it is not necessary to open the opening 66*f* of the trigger valve 66 facing the discharge section 21 in the area (areas except areas E1, E2) which is not affected by the dynamic pressure of the refrigerant gas G and the dynamic pressure of the refrigerant oil R ejected from the cyclone block 60. If the opening 66*f* is formed in such an area which is affected by such dynamic pressure, the closure plates 64*d*, 64*d* are provided in the cyclone block 60 so as to prevent the influence of the dynamic pressure of the refrigerant gas G and the dynamic pressure of the refrigerant oil R by the closure plates 64*d*, 64*d*.

A member which is provided near the opening 66*f* for preventing the influence of the dynamic pressure is not limited to the two planar closure plates 64*d*, 64*d*. Another shape or number of the closure plate can be used. It is also not limited to a member which is formed separately from the cyclone block 60, and it can be formed integrally with the cyclone block 60 as casting.

In FIG. 5, the closure plates 64*d*, 64*d* are additionally provided after the opening 66*f* of the trigger valve 66 facing the discharge section 21 is formed in the area which is not affected by the dynamic pressure of the refrigerant gas G and the dynamic pressure of the refrigerant oil R ejected from the cyclone block 60. With this constitution, the influence of the dynamic pressure of the refrigerant gas G and the refrigerant oil R relative to the operation of the trigger valve 66 can be further eliminated. However, the closure plates 64*d*, 64*d* can be formed in the cyclone block in which the opening 66*f* opens in the area E1 which is affected by the dynamic pressure of the refrigerant gas G ejected from the cyclone block 60 or the area E2 which is affected by the dynamic pressure of the refrigerant oil R.

This opening 66*g* is formed in a position above the center C of the vane back-pressure space 69, and the path 66*a* is eccentric from the center C of the vane back-pressure space 69. With this constitution, the refrigerant gas G flowing in the vane back-pressure space 69 through the path 66*a* from the discharge section 21 due to the opening of the trigger valve 66 easily flows in one direction illustrated by the arrow in FIG. 6A (the clockwise direction with the center C in FIG. 6A).

Figure 6B:
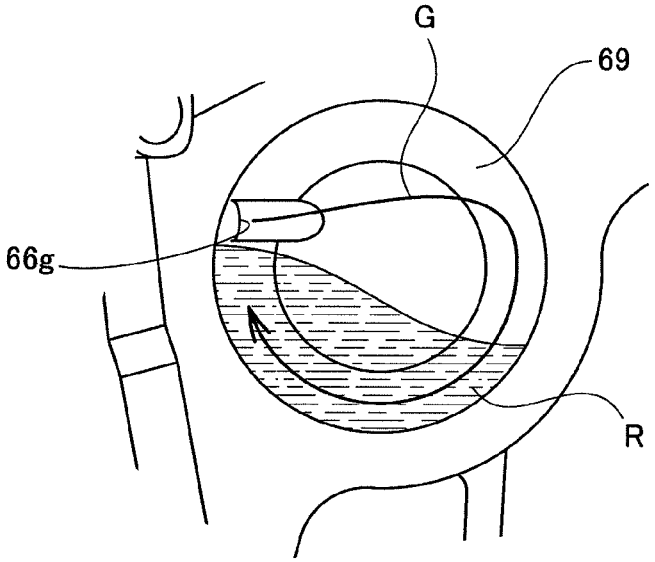
Figure 7:
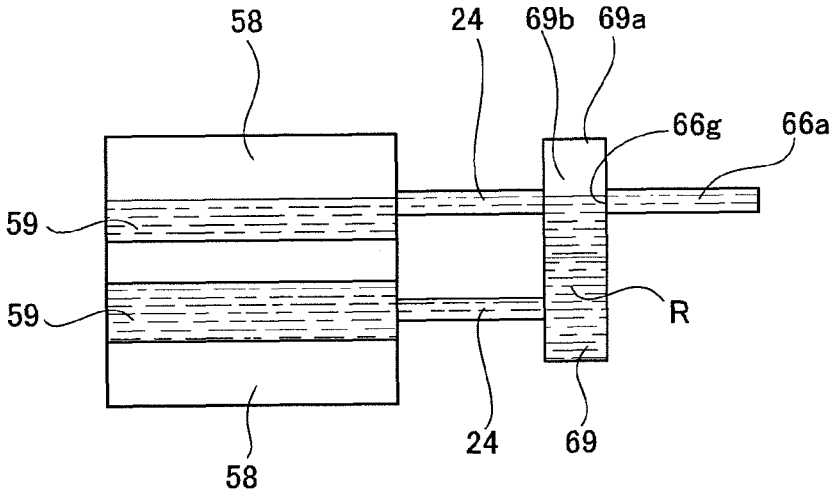
FIG. 7 is a view illustrating a gas confining space in a path from the vane back-pressure space to a vane groove.

Such refrigerant gas G flowing in one direction presses the surface of the refrigerant oil R in the vane back-pressure space 69 to be inclined as illustrated in FIG. 6B, and shakes and agitates the refrigerant oil R, so that the refrigerant oil R is mixed with the refrigerant gas G.

The refrigerant oil R mixed with the refrigerant gas G in the vane back-pressure space 69 is applied to the vanes 58 as back-pressure through the communication path 24, groove 25, and vane grooves 59 in order. The passing speed of the refrigerant oil R mixed with the refrigerant gas G is faster than the passing speed of the solo refrigerant oil R in the flow path from the vane back-pressure space 69 to the vane grooves 59.

Namely, the refrigerant oil R has a viscosity higher than that of the refrigerant gas so a time lag easily occurs until the refrigerant oil acts on the vanes as the vane back-pressure due to the viscosity resistance when the refrigerant oil R passes through the flow path from the vane back-pressure room 69 to the vane grooves 59.

On the other hand, the refrigerant gas G has a viscosity lower than that of the refrigerant oil R, so the viscosity resistance when the refrigerant oil R mixed with the refrigerant gas G passes through the flow path from the vane back-pressure space 69 to the vane grooves 59 is smaller than the viscosity resistance of the solo refrigerant oil R. Thus, the time lag until the refrigerant oil acts on the vanes as the vane back-pressure becomes considerably smaller than the time lag of the solo refrigerant oil R.

Accordingly, it becomes possible to reduce a time required for the projection of the vanes 58 due to the refrigerant gas G flowed in the vane back-pressure space 69 through the path 66*a* from the discharge section 21 owing to the opening of the trigger valve 66.

According to the compressor 100 of the present embodiment, since the opening 66*g* of the path 66*a* of the trigger valve 66 on the side facing the vane back-pressure space 69 is formed in a portion under the top portion 69*a* of the vane back-pressure space 69, the liquid refrigerant L that the refrigerant gas G condenses and the refrigerant oil R are accumulated in the vane back-pressure of the space 69, and the opening 66*g* of the path 66*a* of the trigger valve 66 is closed by the accumulated refrigerant L and the refrigerant oil R, and a space 69*b* in which the refrigerant gas G remains is left above the opening 66*g* closed by the liquid refrigerant L and the refrigerant oil R even if the vane back-pressure space 69, communication path 24, groove 25 and vane grooves 59 are closed.

More specifically, all of the vane back-pressure space 69, communication path 24, groove 25 and vane grooves 59 are not completely filled by the liquid refrigerant L and the refrigerant oil R.

Accordingly, even if the liquid (liquid refrigerant L and refrigerant oil R) in the vane back-pressure space 69, communication path 24, groove 25 and vane grooves 59 are compressed due to the forcible pushing-back of the vanes 58 to the vane grooves 59, the space in which the refrigerant gas G remains becomes a buffer space, so that the liquid compression condition can be prevented.

The compressor 100 of the present embodiment uses the ball valve 66*b* and the spring 66*c* as the trigger valve 66. However, the pressure-regulating valve (trigger valve) is not limited thereto. Various known modifications can be applied. For example, an elastic member can be used instead of the spring 66*c*, and an elastic plate-like valve can be used instead of the ball valve 66*b*.

According to the compressor of the present embodiment, the pressure-regulating valve is not affected by the jet flow force of the gas ejected from the oil separator. Therefore, the opening and closing operation of the pressure-adjusting valve is accurately performed by the pressure (static pressure) of the discharge section.

Although the embodiment of the present invention has been described above, the present invention is not limited thereto. It should be appreciated that variations may be made in the embodiment described by persons skilled in the art without departing from the scope of the present invention.

What is claimed is:

1. A compressor, comprising:

a housing;

a main body in the housing, the main body having a vane back-pressure space configured to accumulate pressure to project a vane so as to form a compression room for compressing gas; and a centrifugal oil separator, the housing having a discharge section to which a gas from an opening of the oil separator is ejected;

wherein the oil separator includes a pressure-adjusting valve configured to adjust a pressure of the vane back-pressure space based on a pressure of the discharge section; and wherein the pressure-adjusting valve is located at a lower side of the opening of the oil separator.

2. The compressor according to claim 1, wherein the pressure-adjusting valve includes a portion configured to detect the pressure of the discharge section, and wherein the portion configured to detect the pressure of the discharge section is located in a different area from an area where the gas is ejected from the oil separator.

3. The compressor according to claim 1, further comprising a closure member around the pressure-adjusting valve and configured to block the gas ejected from the oil separator from entering an area adjacent to the pressure-adjusting valve.

4. The compressor according to claim 2, further comprising a closure member around the portion configured to detect the pressure of the discharge section and configured to block the gas ejected from the oil separator from entering an area adjacent to the portion configured to detect the pressure of the discharge section.

5. The compressor according to claim 1, wherein the pressure-adjusting valve is located in the oil separator, and is located at an upper side of a discharge hole from which oil is ejected from the oil separator.

6. The compressor according to claim 5, wherein a portion configured to detect the pressure of the discharge section is located in an area different from an area where the oil centrifugally separated from the oil separator is ejected.

7. The compressor according to claim 5, further comprising a closure member around the pressure-adjusting valve and configured to block the oil ejected from the oil separator from entering an area adjacent to the pressure-adjusting valve.

8. The compressor according to claim 6, further comprising a closure member around the portion configured to detect the pressure of the discharge section and configured to block the oil ejected from the oil separator from entering an area adjacent to the portion configured to detect the pressure of the discharge section.

9. The compressor according to claim 1, wherein the pressure-adjusting valve comprises:

a path directly connecting the vane back-pressure space to the discharge space; and a valve member configured to selectively close the path based on a pressure differential between the vane back-pressure space and the discharge space.

10. The compressor according to claim 9, wherein the valve member comprises a ball and a spring for applying a biasing force to the ball in the opening direction.

* * * * *